US007403596B1

(12) United States Patent
Chaves

(10) Patent No.: US 7,403,596 B1
(45) Date of Patent: Jul. 22, 2008

(54) X-RAY TUBE HOUSING WINDOW

(75) Inventor: Arthur A. Chaves, Sandy, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 10/324,784

(22) Filed: Dec. 20, 2002

(51) Int. Cl.
*H01J 35/18* (2006.01)

(52) U.S. Cl. ..... 378/140; 378/141

(58) Field of Classification Search ..... 378/127, 378/130, 140, 141, 161
See application file for complete search history.

(56) References Cited

U.S. PATENT DOCUMENTS

| | | | | |
|---|---|---|---|---|
| 2,896,105 | A | 7/1959 | Hosemann | |
| 4,107,562 | A | 8/1978 | Koller et al. | |
| 4,115,697 | A | 9/1978 | Hounsfield et al. | |
| 4,122,967 | A | 10/1978 | Röhrich | |
| 4,159,437 | A | 6/1979 | Sahores | |
| 4,166,231 | A * | 8/1979 | Braun | 378/125 |
| 4,622,687 | A | 11/1986 | Whitaker et al. | |
| 4,709,559 | A | 12/1987 | Dotzauer et al. | |
| 4,862,490 | A | 8/1989 | Karnezos et al. | |
| 5,018,181 | A | 5/1991 | Iversen et al. | |
| 5,056,126 | A | 10/1991 | Klostermann et al. | |
| 5,161,179 | A | 11/1992 | Suzuki et al. | |
| 5,173,612 | A | 12/1992 | Imai et al. | |
| 5,357,555 | A * | 10/1994 | Gerth | 378/200 |
| 5,541,975 | A | 7/1996 | Anderson et al. | |
| 5,585,644 | A | 12/1996 | Van Der Borst | |
| 5,689,542 | A | 11/1997 | Lavering et al. | |
| 5,737,387 | A | 4/1998 | Smither | |
| 6,002,745 | A | 12/1999 | Miller et al. | |
| 6,005,918 | A | 12/1999 | Harris et al. | |
| 6,074,092 | A | 6/2000 | Andrews | |
| 6,115,454 | A | 9/2000 | Andrews et al. | |
| 6,118,852 | A * | 9/2000 | Rogers et al. | 378/140 |
| 6,125,169 | A | 9/2000 | Wandke et al. | |
| 6,453,010 | B1 * | 9/2002 | Miller et al. | 378/130 |
| 2002/0018544 | A1 * | 2/2002 | Chabin et al. | 378/205 |

* cited by examiner

*Primary Examiner*—Chih-Cheng G Kao
(74) *Attorney, Agent, or Firm*—Workman Nydegger

(57) ABSTRACT

An x-ray transmissive housing window for reducing non-uniform attenuation of x-rays in a rotationally driven x-ray device is disclosed. The x-ray tube is disposed within an interior portion of an outer housing that is filled with cooling fluid. An x-ray beam produced by the tube passes through the housing window, which is disposed in a port defined in the outer housing. The housing window includes a convexly shaped inner surface adjacent the cooling fluid. The shape of the window's inner surface cooperates with centripetal and other dynamic forces within the x-ray device to act on bubbles that form in the cooling fluid and attach to the window's inner surface. These forces create a moving force that acts on the bubbles at the housing window inner surface. The convex curvature of the inner surface enables the dynamic forces to displace the bubbles from the x-ray beam transmission region of the housing window.

4 Claims, 6 Drawing Sheets

X-RAY TUBE HOUSING WINDOW

BACKGROUND OF THE INVENTION

1. The Field of the Invention

The present invention generally relates to x-ray generating devices. In particular, the present invention relates to an apparatus for preventing non-uniform attenuation of an x-ray beam by bubbles formed in the cooling fluid of an x-ray generating device.

2. The Related Technology

X-ray producing devices are extremely valuable tools that are used in a wide variety of applications, both industrial and medical. For example, such equipment is commonly employed in areas such as medical diagnostic examination and therapeutic radiology, semiconductor manufacture and fabrication, and materials analysis.

Regardless of the applications in which they are employed, x-ray devices operate in similar fashion. In general, x-rays are produced when electrons are emitted, accelerated, and then impacted upon a material of a particular composition. This process typically takes place within an evacuated enclosure of an x-ray tube. Disposed within the evacuated enclosure is a cathode, or electron source, and an anode oriented to receive electrons emitted by the cathode. The anode can be stationary within the tube, or can be in the form of a rotating annular disk that is mounted to a rotor shaft which, in turn, is rotatably supported by a bearing assembly. The evacuated enclosure is typically contained within an outer housing, which also serves as a reservoir for a fluid, such as dielectric oil, that serves both to cool the x-ray tube and to provide electrical isolation between the tube and the outer housing.

In operation, an electric current is supplied to a filament portion of the cathode, which causes a cloud of electrons to be emitted via a process known as thermionic emission. A high voltage potential is placed between the cathode and anode to cause the cloud of electrons to form a stream and accelerate toward a focal spot disposed on a target surface of the anode. Upon striking the target surface, some of the kinetic energy of the electrons is released in the form of electromagnetic radiation of very high frequency, i.e., x-rays. The specific frequency of the x-rays produced depends in large part on the type of material used to form the anode target surface. Target surface materials with high atomic numbers ("Z numbers") are typically employed. The target surface of the anode is oriented so that the x-rays are emitted as a beam through windows defined in the evacuated enclosure and the outer housing. The emitted x-ray beam is then directed toward an x-ray subject, such as a medical patient, so as to produce an x-ray image.

Generally, only a small portion of the energy carried by the electrons striking the target surface of the anode is converted to x-rays. The majority of the energy is rather released as heat. To help dissipate this heat, the cooling fluid disposed in the outer housing assists in absorbing heat from surfaces of the x-ray tube and removing it from the x-ray device. This heat removal can be accomplished, for example, via radiation of the heat from the outer surface of the housing, or by continuously circulating the cooling fluid through a heat exchanger.

Despite the overall success of the cooling fluid in dissipating heat from the x-ray tube, however, certain areas within the x-ray device may not be adequately cooled. One of these areas is located between the respective windows of the x-ray tube and outer housing. Because of this, extreme heating of the cooling fluid in this localized region may occur. This extreme heating can exceed the ability of the cooling fluid to remove the heat. Consequently, intermittent boiling of the cooling fluid can occur in the localized region between the two windows, creating air bubbles within the fluid that tend to congregate on the inner surface of the outer housing window.

The accumulation of bubbles at the inner surface of the outer housing window is undesirable for several reasons. Principal among these relates to the fact that the air bubbles present in the cooling fluid at the window surface possess a distinct density, and thus a distinct rate of x-ray attenuation, from the fluid itself. Because of this density difference, x-rays passing through a bubbly fluid region will be attenuated a different rate than x-rays passing through a fluid-only region. Thus, bubbles that are created by intense heating of the cooling fluid and are randomly distributed on the inner surface of the outer housing window create a non-uniform attenuation of the x-ray beam that passes through the window. The result is a non-uniform x-ray beam exiting the x-ray device, which in turn produces inferior results for the particular application for which the device is being used. For instance, in medical imaging a non-uniform x-ray beam can cause the image quality and clarity of the radiographic images produced thereby to substantially decrease. For this and other reasons, bubbles present at the inner surface of the outer housing window are highly undesirable.

Non-uniform x-ray beam attenuation can be further exacerbated by an additional factor combining with the accumulation of bubbles on the outer housing window inner surface. As mentioned, many x-ray devices are utilized in connection with medical imaging systems, such as CT scanners. In such systems, the x-ray device is typically mounted on a gantry that spins at high speeds during the scanning process. This spinning subjects the x-ray device and its components to various rotationally related forces. These dynamic rotational forces are not of such a nature as to completely displace fluid bubbles formed at the surface of a typical housing window. However, these forces are sufficient to cause bubbles at the window surface to oscillate during gantry rotation. This bubble oscillation further increases the uneven attenuation of the x-ray beam, resulting in even more non-uniform beam characteristics.

In light of the above discussion, it would be generally desirable to produce an x-ray tube having superior beam characteristics. Particularly, a need exists for an x-ray device, and, more particularly, a housing window that is designed to eliminate the collection of cooling fluid bubbles on the housing window in order to reduce non-uniformity for the x-ray beam, especially in high-rotational environments.

BRIEF SUMMARY OF THE INVENTION

The present invention has been developed in response to the above and other needs in the art. Briefly summarized, embodiments of the present invention are directed to an x-ray transmissive housing window assembly for use in the outer housing of x-ray devices used particularly in high rotational environments. Examples of high rotation environments include an x-ray device disposed in the gantry of a medical imaging device, such as a CT scanner. The outer housing has disposed therein an x-ray tube that is configured to produce x-rays. A cooling fluid, such as a dielectric oil, is also contained within the outer housing and envelops the x-ray tube to cool it and to electrically insulate it from the outer housing. The present housing window is disposed in a port defined in the outer housing. An x-ray transmissive window in the x-ray tube is cooperatively positioned with respect to the present housing window so as to enable x-rays produced within the tube to pass from the tube window, through a portion of the cooling fluid, then finally through the present housing window to exit the device.

The housing window of the present invention is configured to prevent the accumulation thereon of bubbles that form in the cooling fluid during operation of the x-ray device. In one embodiment, the housing window is rounded so as to possess a non-planar, arcuate cross sectional shape. This results in the outer surface of the window having a concave surface and the inner surface, which is adjacent the cooling fluid, having a convex surface.

The convexly shaped inner surface prevents bubbles in the cooling fluid from congregating thereon and affecting the uniformity of the x-ray beam passing through the window. When excessive heating or other process produces bubbles in the cooling fluid, a certain number of the bubbles contact and remain on the inner surface of the outer housing window. In contrast to previous window designs, the convex shape of the inner window surface prevents the bubbles from readily establishing a point of equilibrium where the bubble can remain stationary on the inner surface. At the same time, dynamic forces introduced into the x-ray device via the rotation of the system in which the device is disposed act on the bubbles. Because of the convex shape of the window's inner surface, these dynamic forces displace the bubbles from the central portion of the window and cause them to slide along the inner window surface toward the periphery of the window out of the path of the x-ray beam. In this way, a clear x-ray beam path adjacent the central portion of the window is established, and the uniformity of the beam is preserved.

Other possible embodiments of the present invention include housing windows having multiple cross sectional curvatures, frustoconical shapes, and saddle-shaped configurations.

These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Reference will now be made to figures wherein like structures will be provided with like reference designations. It is understood that the figures are diagrammatic and schematic representations of presently preferred embodiments of the invention, and are not limiting of the present invention, nor are they necessarily drawn to scale.

FIGS. 1-8C depict various features of embodiments of the present invention, which is generally directed to an x-ray transmissive window for use in x-ray device housings. The present window ensures uniform x-ray beam transmission by preventing the accumulation of cooling fluid bubbles in the region of the window through which the x-ray beam passes. Note that, though the description to follow concentrates on the use of the present window in connection with x-ray devices that are utilized in rotating apparatus, such as medical imaging CT scanners, the principles taught herein can also be suitably applied to other x-ray devices or fluid-filled apparatus where bubble accumulation on a window or similar component is to be avoided.

As used herein, "fluid" is understood to encompass any one of a variety of substances that can be employed in cooling and/or electrically isolating an x-ray or similar device. Examples of fluids include, but are not limited to, de-ionized water, insulating liquids, and dielectric oils.

Figure 1:
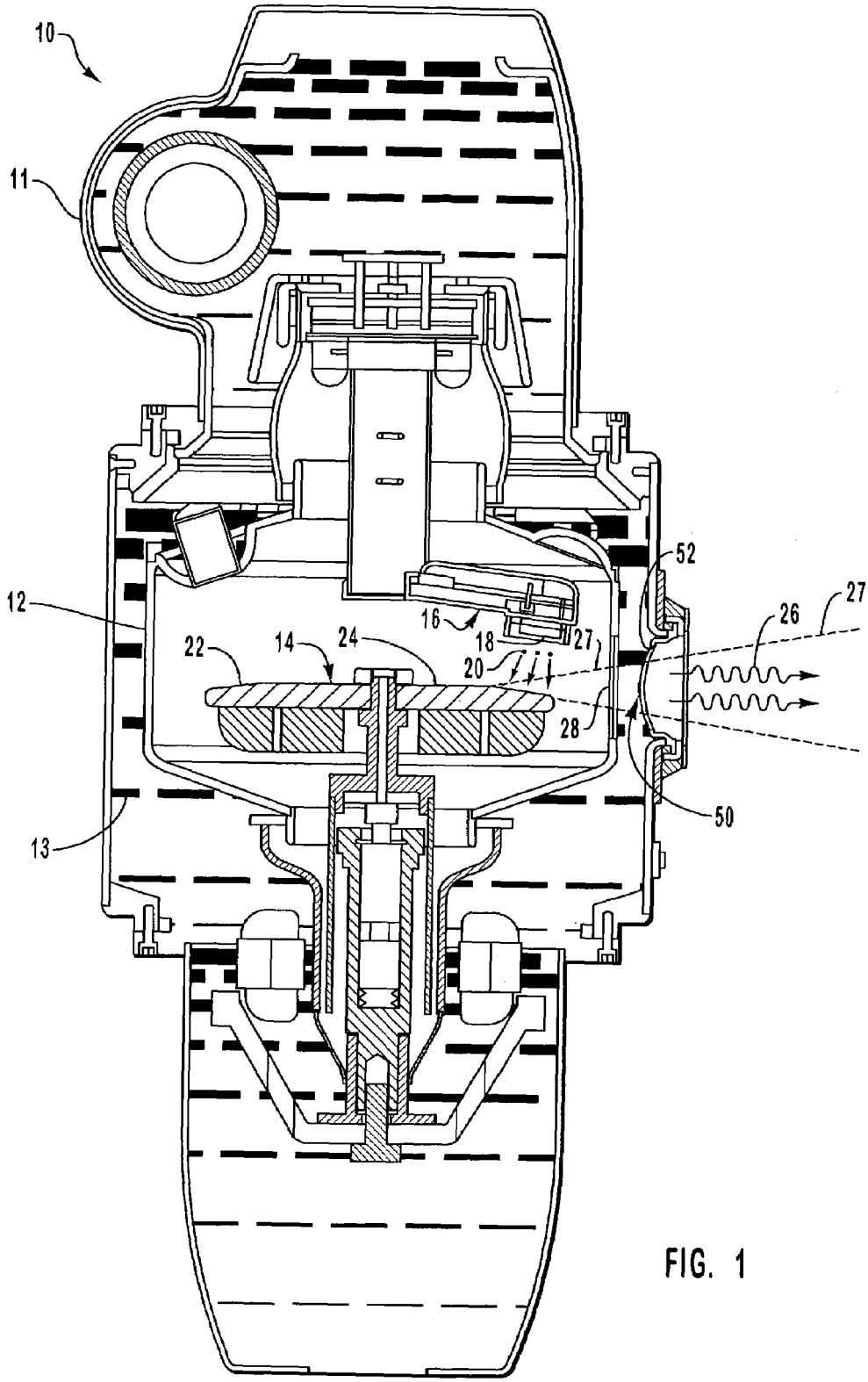
FIG. 1 is a simplified cross sectional depiction of an x-ray device incorporating a housing window according to one embodiment of the present invention.

Reference is first made to FIG. 1, which illustrates a simplified structure of a conventional rotating anode-type x-ray tube, designated generally at 10. X-ray tube 10 includes an outer housing 11, within which is disposed an evacuated enclosure 12. A cooling fluid 13 is also disposed within the outer housing 11 and circulates around the evacuated enclosure 12 to assist in tube cooling and to provide electrical isolation between the evacuated enclosure and the outer housing. In one embodiment, the cooling fluid 13 comprises dielectric oil, which exhibits desirable thermal and electrical insulating properties.

Disposed within the evacuated enclosure 12 are a rotating anode 14 and a cathode 16. The anode 14 is spaced apart from and oppositely disposed to the cathode 16, and is at least partially composed of a thermally conductive material such as copper or a molybdenum alloy. The anode 14 and cathode 16 are connected within an electrical circuit that allows for the application of a high voltage potential between the anode and the cathode. The cathode 16 includes a filament 18 that is connected to an appropriate power source, and during operation, an electrical current is passed through the filament 18 to cause electrons, designated at 20, to be emitted from the cathode 16 by thermionic emission. The application of a high voltage differential between the anode 14 and the cathode 16 then causes the electrons 20 to accelerate from the cathode filament 18 toward a focal track 22 that is positioned on a target surface 24 of the rotating anode 14. The focal track 22 is typically composed of tungsten or a similar material having a high atomic ("high Z") number. As the electrons 20 accelerate, they gain a substantial amount of kinetic energy, and upon striking the target material on the focal track 22, some of this kinetic energy is converted into electromagnetic waves of very high frequency, i.e., x-rays 26, shown in FIG. 1.

The focal track 22 and the target surface 24 are oriented so that emitted x-rays are directed toward an evacuated enclosure window 28. The evacuated enclosure window 28 is comprised of an x-ray transmissive material that is positioned within a port defined through a wall of the evacuated enclosure 12 at a point adjacent the focal track 22.

Figure 2:
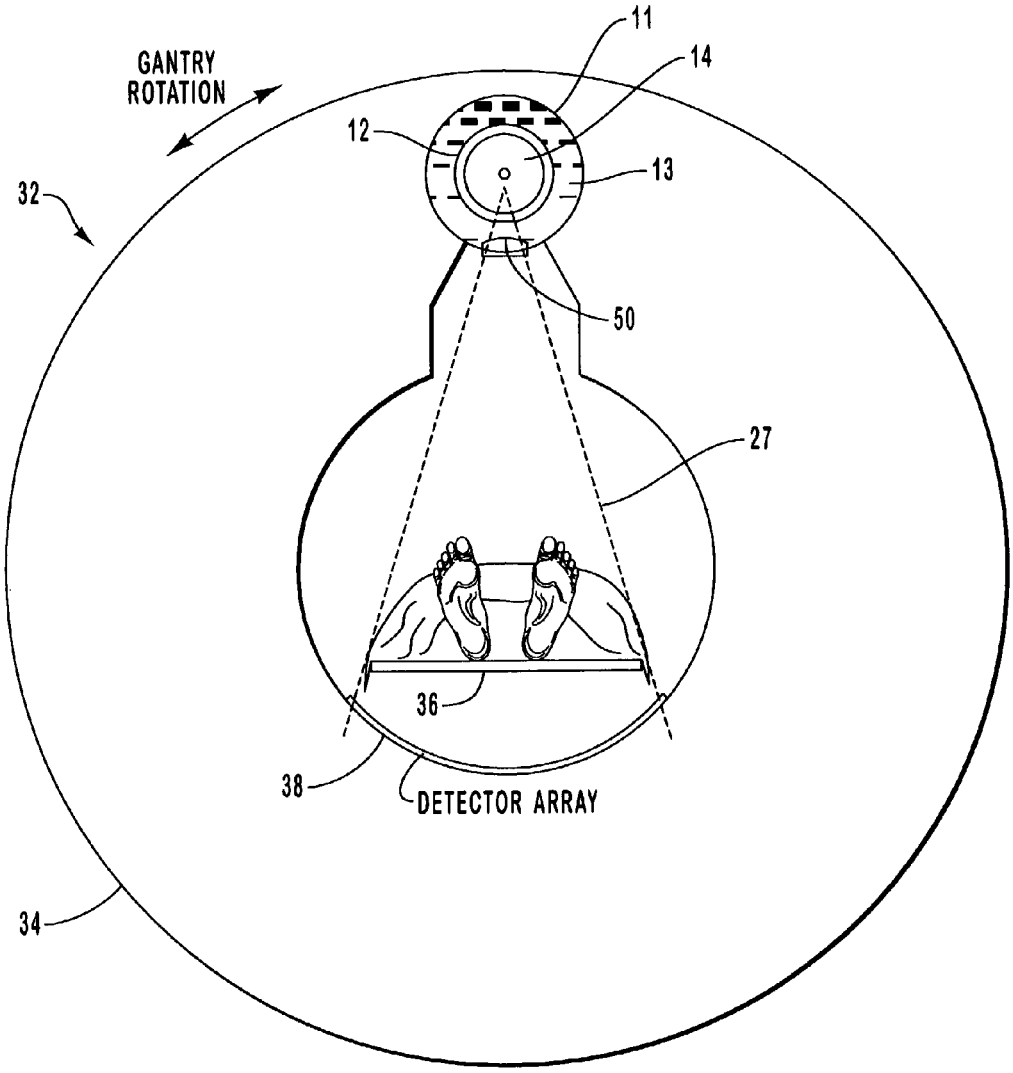
FIG. 2 is a depiction of one environment wherein an x-ray device including one embodiment of the present housing window is used.

According to one embodiment of the present invention, an outer housing window 50, made in accordance with one embodiment of the present invention, is disposed adjacent the evacuated enclosure window 28, as generally shown in FIG. 1. Also comprised of an x-ray transmissive material, such as aluminum, the outer housing window 50 is disposed in a port 52 defined in a wall of the outer housing 11. As will be described, the window 50 is attached in a fluid-tight arrangement to the outer housing 11 so as to enable the x-rays 26 to pass from the window 28 in the evacuated enclosure 12 and through the outer housing window. At the same time, the window 50 is configured to prevent the accumulation thereon of bubbles formed in the cooling fluid 13 that can otherwise cause non-uniform attenuation of the x-ray emission from the tube 10. The x-rays 26 that emanate from the evacuated enclosure 12 and pass through the outer housing window 50 do so substantially as a conically diverging beam, the path of which is generally indicated at 27 in FIG. 1, and also in FIGS. 2 and 3. Reference is now made to FIG. 2, which depicts one operating environment in which an x-ray tube having an outer housing window made in accordance with embodiments of the present invention can be utilized. FIG. 2 shows a CT scanner depicted at 32, which generally comprises a rotatable gantry 34 and a patient platform 36. An x-ray tube, such as the x-ray tube 10 depicted in FIG. 1, is shown mounted to the gantry 34 of the scanner 32. In operation, the gantry 34 rotates about a patient lying on the platform 36. The x-ray tube 10 is selectively energized during this rotation, thereby producing a beam of x-rays that emanate from the tube as the x-ray beam path 27. After passing through the patient, the unattenuated x-rays are received by a detector array 38. The x-ray information received by the detector array 38 can be manipulated into images of internal portions of the patient's body to be used for medical evaluation and diagnostics.

The x-ray tube 10 of FIG. 2 is shown in cross section and depicts the outer housing 11, the evacuated enclosure 12, and the anode 14 disposed therein, at which point the x-rays in beam 27 are produced. The x-ray tube 10 further shows the outer housing window 50, made in accordance with one embodiment of the present invention, disposed in the outer housing 11 adjacent the cooling fluid 13. As will be seen, the outer housing window 50 is designed and constructed as to prevent the accumulation of bubbles formed in the cooling fluid 13 during operation of the tube. Thus, problems such as bubble oscillation across the face of the window, which is induced by rotation of the gantry and which results in the non-uniform attenuation of the x-ray beam 27 discussed above, are avoided.

Figure 3:
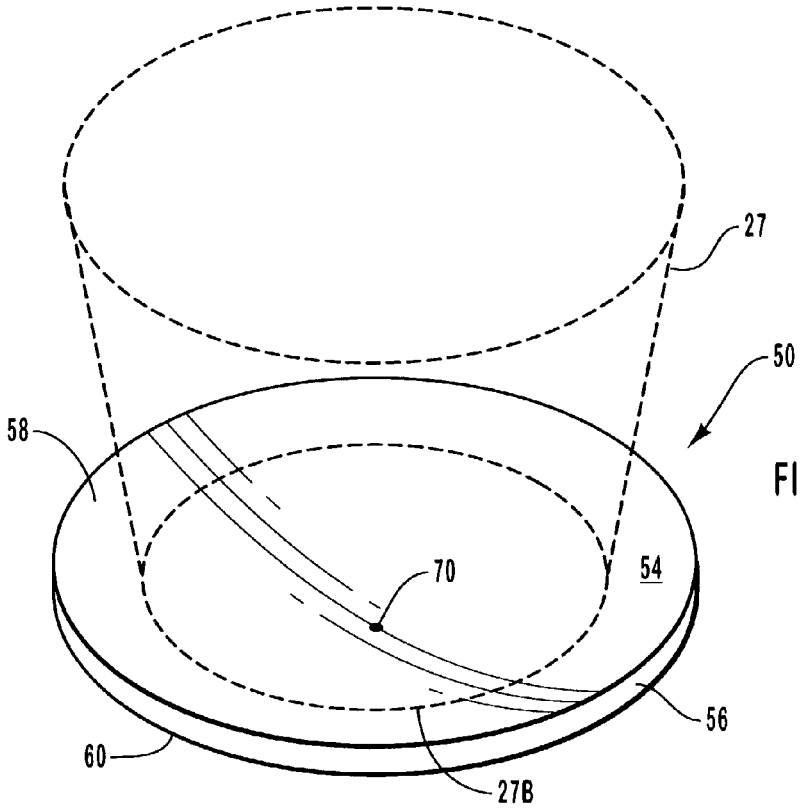
FIG. 3 is a perspective view of the housing window seen in FIG. 1.
Figure 4:
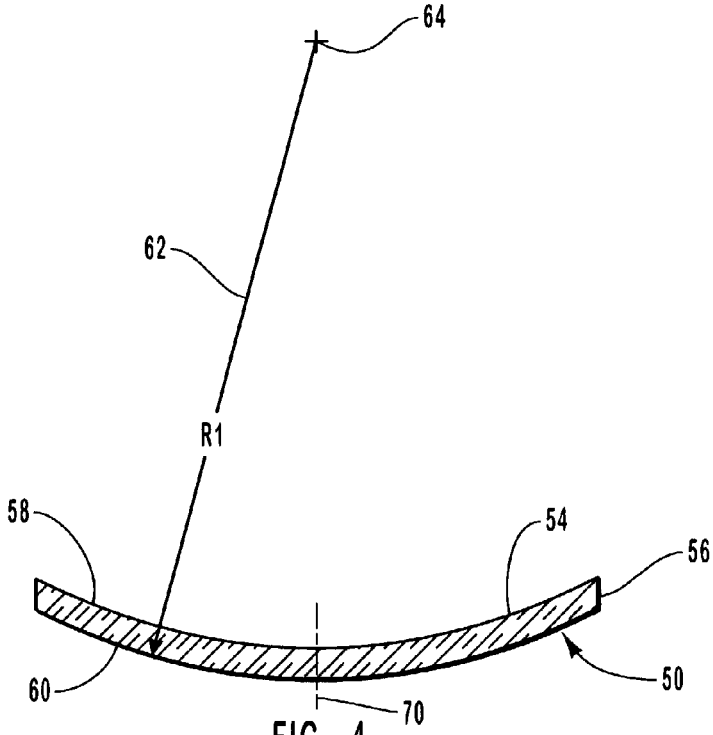
FIG. 4 is a cross sectional view of the housing window of FIG. 3.

Reference is now made to FIGS. 3 and 4 in describing further details concerning the present outer housing window 50. As can be seen, the window 50 in one embodiment comprises an arcuate, bowl-like body 54 having a circular edge or outer periphery 56. The body 54 can be manufactured from a variety of suitable x-ray transmissive materials, but in one embodiment it is comprised of aluminum. The bowl-like shape of the body 54 creates non-planar window surfaces: an outer surface 58 defining a concave shape, and an inner surface 60 defining a convex shape. In the illustrated embodiment, the curvature of the convex inner surface 60 is described by a specified radius 62 extending from an imaginary point 64. Thus, the inner surface 60 of the body 54 of the window 50 can be thought of as comprising a portion of the surface of a sphere described by the radius 62. The curvature of the concave outer surface 58 closely matches that of the convex inner surface 60 such that the thickness of the body 54 (i.e., the distance between the outer and inner surfaces) is substantially uniform. However, it is also possible to manufacture the window 50 such that the respective curvatures of the outer and inner surfaces 58 and 60 are distinct from one another. In such a case, the thickness of the body 54 would vary as a function of position on the window 50. Thus, the concave and convex shapes of the outer and inner surfaces 58 and 60 can be configured to either match one another in curvature or not, as may be needed for a particular application. Further, and as can be appreciated, the curvature of both the outer and inner surfaces 58 and 60 can be modified in a variety of ways, as discussed more fully further below.

In FIG. 3, the x-ray beam path 27 is shown in dashes as the area through which the x-rays 26 (see FIG. 1) would pass if the window 50 were attached to an operating x-ray tube. Thus, the window 50 intercepts a circular slice 27B of the x-ray beam path 27, and it is from this area of the window 50 that the present invention is most concerned with removing bubbles from the inner window surface.

As its name implies, the inner surface 60 of the window 50 is disposed in the port 52 of the outer housing 11 so as to be adjacent the inner volume of the housing and, correspondingly, adjacent the cooling fluid 13 disposed therein. In one embodiment, the periphery 56 of the window 50 is attached to the port 52 via any suitable means of attachment, such as brazing or welding, such that a fluid-tight seal between the window and the outer housing 11 is established. Alternatively, the window 50 can be indirectly attached to the outer housing 11 via an intermediate structure, such as an attachment ring (not shown). Because the shape of the window periphery 56 can be varied as seen below, the modes of attachment can also vary according to the particular configuration of the window 50.

Figure 5B:
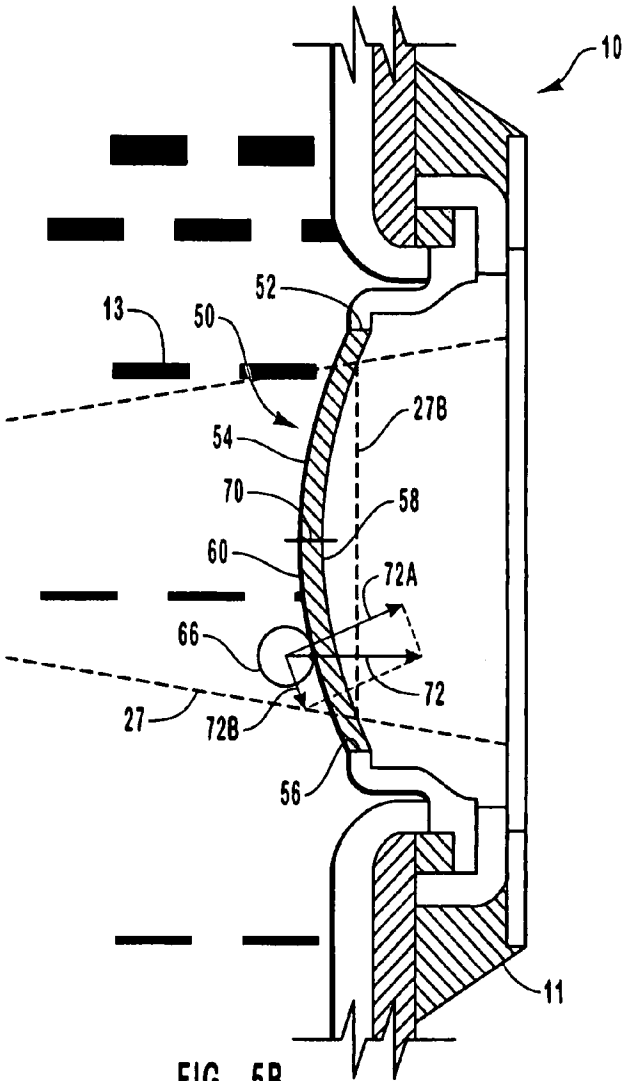
FIG. 5B is a cross sectional view of the housing window as in FIG. 5A, showing the bubble adjacent the window in a second position.
Figure 5A:
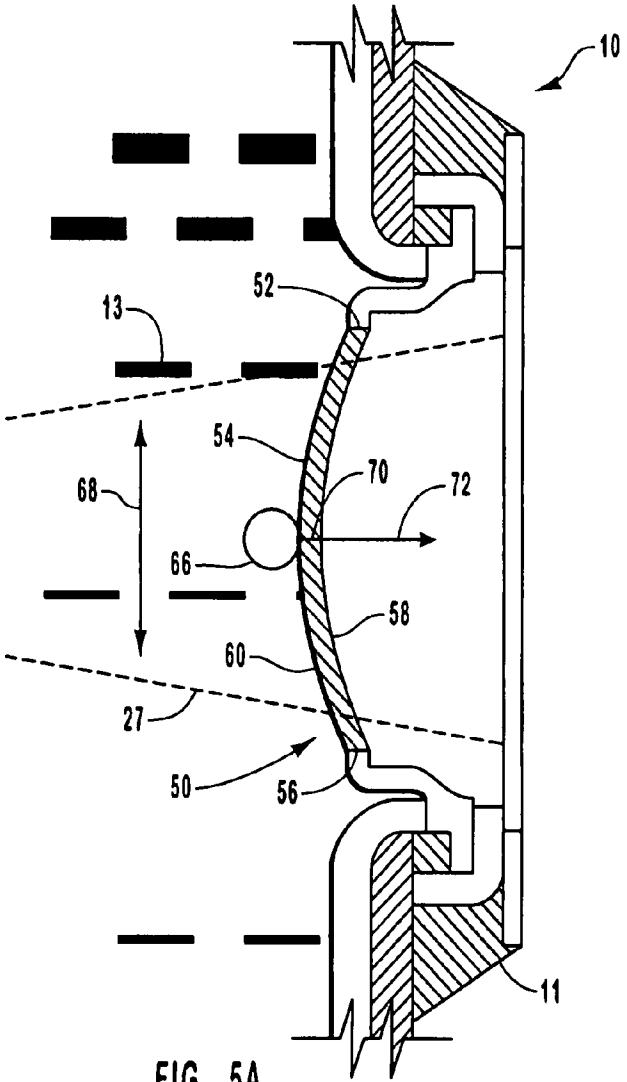
FIG. 5A is a cross sectional view of the housing window of FIG. 4, showing an exemplary bubble disposed adjacent the window in a first position.

Reference is now made to FIGS. 5A and 5B in describing operation of the window 50 during operation of the x-ray tube 10. As mentioned, the inner surface 60 of the window 50 is convexly shaped. As such, the inner window surface 60 in presently preferred embodiments serves as one means for preventing the accumulation of bubbles on the housing window. During tube operation, bubbles may form in the cooling fluid 13, which continually circulates within the outer housing 11 adjacent the inner surface 60. These bubbles may be produced, for instance, by excessive heating within the outer housing 11, which can cause localized boiling of the cooling fluid 13 to occur. One or more bubbles present in the cooling fluid during tube operation can migrate to and contact the inner window surface 60. One such bubble is shown at 66, disposed in contact with the inner surface 60 of the window 50 in FIG. 5A. During tube operation, a relatively large number of bubbles can accumulate on the inner surface 60 in a portion of the window 50 through which the x-ray beam 27 passes. As described previously, bubbles that are positioned on the inner window surface 60 in such a manner can cause the x-ray beam 27 to be unevenly attenuated and reduce the quality of the beam.

According to the principles of the invention taught herein, the present window 50 is configured to alleviate the above situation. In preferred embodiments, the x-ray tube 10 is disposed within a rotationally driven system, such as the gantry of a medical imaging device (not shown). The rotation of the imaging device introduces dynamic forces into the tube 10 during operation. Among these are lateral forces that act upon the bubble 66, as indicated by the lateral arrow 68 in FIG. 5A. Whereas known windows having no curvature of the inner window surface are largely unaffected by these lateral forces (other than to facilitate a back-and-forth oscillation of the bubbles on the window surface), the present window 50 takes advantage of such forces to remove unwanted bubbles 66 from the window surface, specifically the portion of the window through which the x-ray beam 27 passes. The convex curvature of the inner window surface 60 creates a surface on which equilibrium for any bubble 66 disposed thereon is difficult to achieve. Thus the influence of relatively small moving forces, such as the lateral dynamic forces introduced via rotation of the x-ray tube 10 described above, are sufficient to upset whatever equilibrium the bubble may achieve on the inner window surface 60. It is noted that only about the vertex of the inner surface 60, indicated at central point 70, is any degree of equilibrium typically possible in the present invention. Even at the central point 70, however, the lateral forces induced in the tube 10 are sufficient to dislodge a bubble, such as the bubble 66, from its unstable equilibrium.

Because of their lack of equilibrium, each bubble 66 is easily moved along the inner surface 60. At this point, a centripetal dynamic force induced by rotation of the x-ray tube 10 within the rotational apparatus in which the tube 10 is disposed acts on the bubble 66, as seen in FIG. 5B. This centripetal, or centrally directed, force, indicated at 72, can be resolved into a normal force 72A, which is directed perpendicular to the inner window surface 60 at the point of contact with the bubble 66, and a tangential force 72B, which is directed along a line tangent to the point of contact of the bubble with the inner surface. Because of the lack of equilibrium of the bubble 66, the tangential force component 72B is unbalanced. This results in movement of the bubble shown in FIG. 5A from the central point 70 along the inner surface 60 toward the periphery 56 of the window 50, as seen in FIG. 5B. The bubble 66, under normal conditions, will continue travel in this direction until it has slid off the window 50 completely. At the very least, the bubble will be moved by the tangential force component 72B a distance sufficient to remove it from the x-ray beam path 27B passing through the window 50. This same process will occur with any bubble present on the inner surface 60 of the window 50, regardless of its initial position on the surface. In conjunction with this, it is desirable to manufacture the window 50 so that its inner surface 60 is smooth such that surface friction between any bubbles and the surface is minimized. As a result of this process, then, the x-ray beam path at the inner surface 60 of the window 50 is cleared of all bubbles, which in turn increases the uniformity of the x-rays 26 passing therethrough and prevents variable attenuation that is caused by bubbles present on the window surface.

Figure 6:
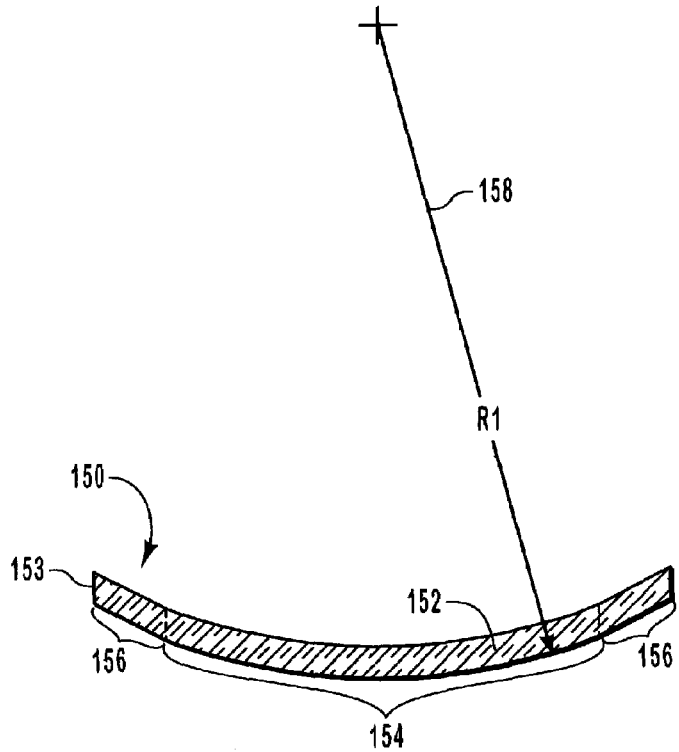
FIG. 6 is a cross sectional view of a housing window made in accordance with another embodiment of the present invention.

Reference is now made to FIG. 6. As already suggested, the outer housing window 50 is not limited to the particular shape described in connection with FIGS. 3-5B. Accordingly, in one embodiment shown in FIG. 6, an outer housing window 150 having an alternative non-planar shape is depicted. The window 150 comprises a body 152 having a circular periphery 153. The body 152, seen in cross section, includes an arcuate first central portion 154 and a second outer portion 156. The central portion 154 has a curvature defined by a radius 158, similar to the previous embodiment shown in FIG. 4. The outer portion 156, which is annularly defined about the central portion 154, is not defined by a radius, but rather extends frustoconically as a ridge about the central portion. Given the difference in their respective shapes, the central and outer flat portions 154 and 156 can be separately made then joined, but are preferably integrally formed as a single piece and machined to their respective shapes.

Figure 7:
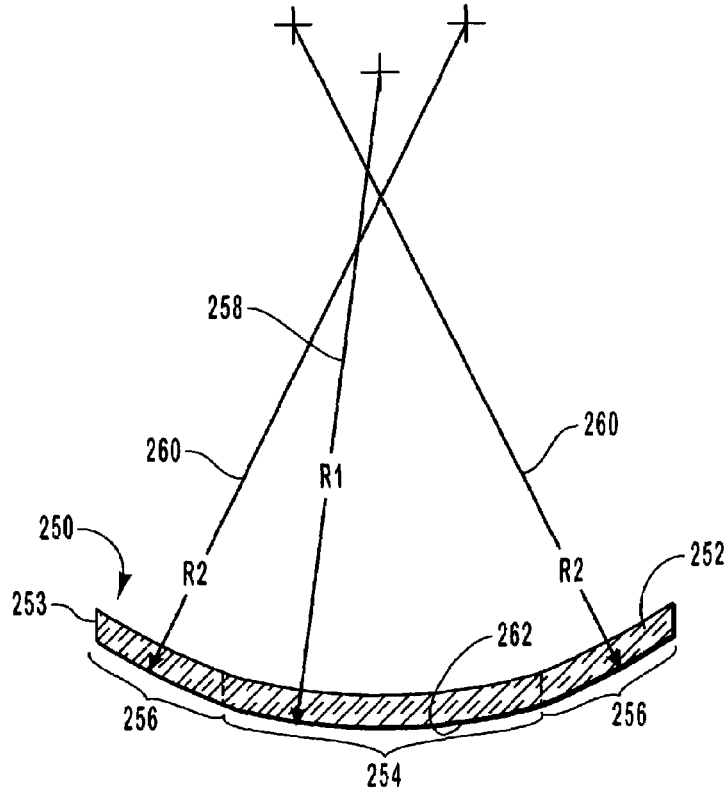
FIG. 7 is a cross sectional view of a housing window made in accordance with yet another embodiment of the present invention.

FIG. 7 depicts another embodiment showing an alternative arrangement of the present outer housing window. A window 250 having a body 252 and a circular outer periphery 253 is shown in cross section. The window 250 includes a central portion 254 and an outer portion 256 annularly disposed about the central portion. As seen in FIG. 7, the central portion 254 possesses a first curvature defined by a first radius 258. The outer portion 256, in contrast, has a second curvature defined by a second radius 260. The first curvature of the first radius 258 can be greater than that of the second curvature defined by second radius 260, as shown in FIG. 7, or vice versa. These curvature variations in the body 252 give an inner surface 262 of the body specified non-planar surface characteristics as may be desired or needed for a particular tube application.

The present embodiment is not limited to that depicted in FIG. 7. Indeed, it is appreciated that three or more radii can be used, to define multiple regions on the window inner surface. This and other modifications of the present embodiment are accordingly contemplated.

Note that the different window configurations shown in FIGS. 4-7 should be considered merely representative of the variety of window shapes that can be utilized in connection with the present invention in order to suit a particular tube application. Accordingly, configurations varying from or in contrast to those explicitly depicted herein are contemplated as also falling within the claims of the present invention.

Figure 8A:
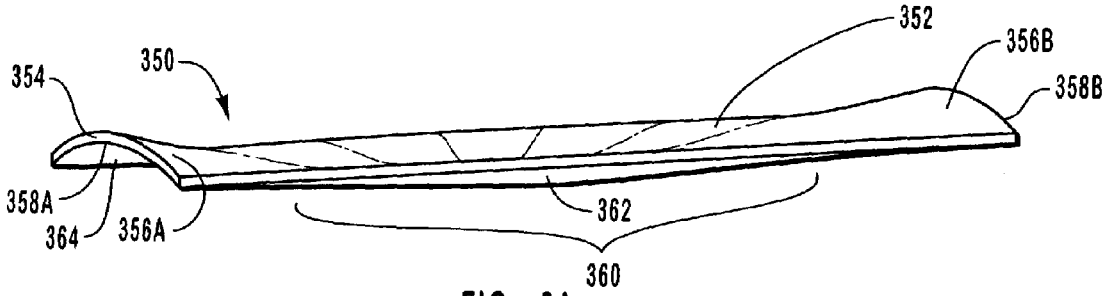
FIG. 8A is a perspective view of a housing window made in accordance with still yet another embodiment of the present invention.
Figure 8B:
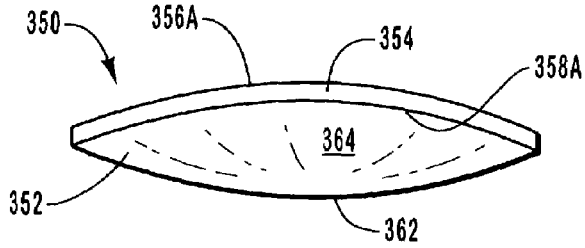
FIG. 8B is an end view of the housing window of FIG. 8A.
Figure 8C:
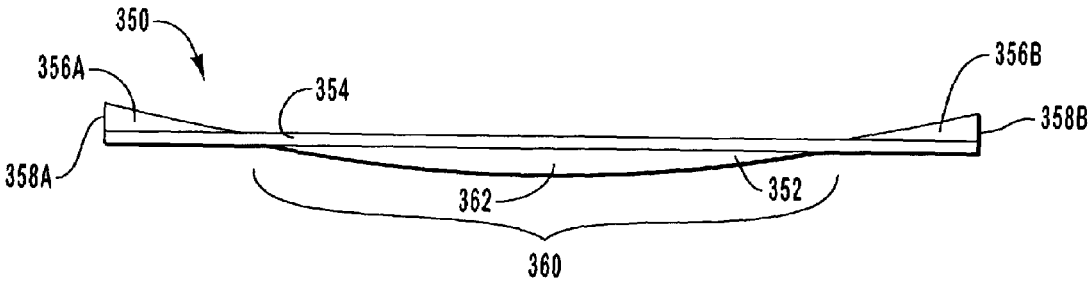
FIG. 8C is a side view of the housing window of FIG. 8A.

Reference is now made collectively to FIGS. 8A-8C. In accordance with principals of the present invention, it is also appreciated that the present window can be configured to fit a variety of ports defined in an outer housing of an x-ray tube. FIG. 8A-8C depict one possible window configuration designed to attach to a rectangular port defined in an x-ray tube outer housing. Specifically, these figures depict a non-planar outer housing window 350 comprising a body 352 defined by a rectangular outer periphery 354. The body 352 of the present window 350 is substantially saddle-shaped, comprising raised and curved portions 356A and 356B adjacent either longitudinal end 358A and 358B, respectively. A central portion 360 disposed between raised portions 356A and 356B has an opposite curvature to that of the raised end portions 356A and 356B such that it descends below the level of the outer periphery 354. The saddle-shaped window 350 configured in this manner is mounted to a port of an outer housing of in x-ray such that an inner surface 362 of the central portion 360 is directed inward to the outer housing, thereby placing it in adjacent contact with a cooling fluid disposed within the housing. A window 350 disposed in this manner in an outer housing of an x-ray tube provides a continuous surface on which bubbles that are formed in the cooling fluid can easily be displaced along the continuously shaped inner surface 362 of the central portion 360 and along inner surfaces 364 of the raised end portions 356A and 356B, in a similar manner as in previous embodiments already described. As before, this removes any bubbles from the inner window surface, resulting in a clear x-ray beam path through the window during tube operation.

In light of the above discussion, therefore, it should be appreciated that each of the inner window surface embodiments, illustrated in FIGS. 5A-8C, depicts merely one means for preventing the accumulation of bubbles on an x-ray tube housing window. Other structures in accordance with the principles taught herein are also contemplated. Furthermore, the particular shape and configuration of the housing window can be modified not only in terms of inner and outer surface shape of the body itself, but also in the shape of the outer periphery of the window as well. In addition to the shapes already described, for example, the outer periphery of the window can be adapted so as to fit square, round, octagonal or other shaped parts in an x-ray tube outer housing. Thus, these and other similar modifications to the window are accordingly considered part of the present invention.

It should also be appreciated that the thickness of the outer housing window can vary according to several factors, including the material used to form the window, and the amount of "soft radiation" that is desired to be attenuated by the window. Though a variety of materials may be employed, in presently preferred embodiments aluminum is used to construct the outer housing window, which preferably possesses a thickness of from about 1.0 to 1.3 millimeters.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. An x-ray device comprising:

a vacuum enclosure having disposed therein an anode and a cathode, the anode being positioned to receive electrons produced by the cathode;

an outer housing within which the vacuum enclosure is disposed, the outer housing configured to hold a volume of cooling fluid; and an x-ray transmissive window positioned in the outer housing, the window comprising a body having a substantially convex inner surface arranged for contact with the cooling fluid, and a portion of the inner surface having a cross-sectional shape that is substantially in the form of a non-elliptical arc, wherein the cross-sectional shape of the substantially convex inner surface is described by a single radius.

2. An x-ray device comprising, a vacuum enclosure having disposed therein an anode and a cathode, the anode being positioned to receive electrons produced by the cathode;

an outer housing within which the vacuum enclosure is disposed, the outer housing configured to hold a volume of cooling fluid; and an x-ray transmissive window positioned in the outer housing, the window comprising a body having a substantially convex inner surface arranged for contact with the cooling fluid, and a portion of the inner surface having a cross-sectional shape that is substantially in the form of a non-elliptical arc, wherein the cross-sectional shape of the substantially convex inner surface is described by multiple radii.

3. An x-ray device, comprising:

a vacuum enclosure having disposed therein an electron-producing cathode and an anode positioned to receive electrons produced by the cathode;

an outer housing within which is disposed the vacuum enclosure and a cooling fluid; and an x-ray transmissive window positioned in the outer housing, the window comprising a body having a substantially convex inner surface arranged for contact with the cooling fluid, and a portion of the inner surface having a cross-sectional shape that is substantially in the form of a circular arc.

4. An x-ray device as defined in claim 3, wherein the substantially convex inner surface is described by one of: a single radius or multiple radii.

* * * * *